US006122874A

United States Patent [19]

Smerilli

[11] Patent Number: 6,122,874

[45] Date of Patent: Sep. 26, 2000

[54] DRY 90

[76] Inventor: Philip Smerilli, 7286 Dickenson Rd. East, Mount Hope, Ontario, Canada, L0R 1W0

[21] Appl. No.: 09/377,524

[22] Filed: Aug. 19, 1999

[51] Int. Cl.[7] ..... E04B 5/00

[52] U.S. Cl. ..... 52/408; 52/169.14; 52/293.3

[58] Field of Search ..... 52/408, 409, 293.3, 52/169.11, 169.14

[56] References Cited

U.S. PATENT DOCUMENTS

| | | | |
|---|---|---|---|
| 4,528,787 | 7/1985 | Rittinge | 52/293.3 X |
| 4,745,716 | 5/1988 | Kuypers | 52/169.14 X |
| 4,890,426 | 1/1990 | Hickman et al. | 52/58 |
| 5,218,793 | 6/1993 | Ball | 52/62 |
| 5,605,019 | 2/1997 | Mazickien et al. | 52/58 |
| 5,794,388 | 8/1998 | Jackman | 52/169.5 |

*Primary Examiner*—David M. Purol
*Attorney, Agent, or Firm*—Patent & Trademark Services; Thomas Zack; Joseph H. McGlynn

[57] ABSTRACT

An expandable waterproof covering system used to protect sub surface areas of a building where the sub surface areas meet at an angle. The covering material is a sheet of expandable waterproof material such as a reinforced dual polycrepe material. Approximately in the center of the covering sheet is a pleated area with a series of folds on each side of the center. The center of the sheet is fit over the joining centerline of the two sub surfaces areas to be covered. If desired, a section of the folds may be restricted in their expansion by stitching the adjacent folds together. With this construction the lower folds may fan out to expand to cover more of the surface areas to be protected than the sections that those fold section which are restricted. This finds particular applicability to covering the outside corners of building before the final exterior veneer layer, such as brick or stone, is applied over the protective covering.

6 Claims, 3 Drawing Sheets

DRY 90

BACKGROUND OF THE INVENTION

This invention relates to material used to assist in the damp or waterproofing of an existing building structure.

When existing building surfaces meet at different angles there is a need to apply a damp proofing or waterproof material over these surfaces before a finishing outer non-waterproof covering surface, like brick or a stone veneer, is applied. Examples of such meeting angular surfaces include 90 degree concrete foundation corners, angular corners around installed bay windows and just about any angular joined exterior building surfaces that need to be protected from the weather, especially moisture.

Two common practices employed in the construction industry to waterproof corners, like outside 90 degree corners, require that the waterproof sheeting material either be cut to accommodate the angular variations or that the material simply be wrapped around the existing corner without any cutting. In both such methods there is the possibility that the sheeting material will have gaps between it and the existing foundation material producing a high possibility that water and moisture will penetrate the covered surfaces of the foundation material.

In one prior art reference that corner sheeting material employed secured edge flanges on the sheet edges to overlap other sheets. Other sealer and flashing apparatus for sub structures used a flexible sheet of material that is vapor permeable and has a liquid impermeable portion along one long edge to form a channel in which is disposed a sealant material.

Foldable and expandable pitch pocket material for encompassing an existing element, like a vent pipe, has also been used. Slits on the horizontal material are aligned with notches on the vertical material to allow for light hand pressure to bend creases in the vertical wall and to obtain the folded pitch pocket. Still another invention used to control water seepage at structural interfaces, such as at a footing and a vertical wall, employed a pliable panel with a water flow path between the panel footing and the floor surface.

DESCRIPTION OF THE PRIOR ART

Material that are used to provide protective moisture proofing surfaces over existing sub structures materials in the construction and building industry are known. For example, in the U.S. Pat. No. 4,890,426 to Hickman et al. a corner sheeting material is employed with secured edge flanges on the sheet edges to overlap other sheets is disclosed.

U.S. Pat. No. 5,218,793 to Ball discloses a sealer and flashing apparatus for sub structures that uses a flexible sheet of material with a vapor permeable and has a liquid impermeable portion along one long edge used to form a channel in which there is a sealant material.

U.S. Pat. No. 5,605,019 to Maziekien et al. discloses a foldable and expandable pitch pocket material for encompassing an existing element, like a vent pipe. Slits on the horizontal material are aligned with notches on the vertical material to allow for light hand pressure to bend creases in the vertical wall and to obtain the folded pitch pocket.

U.S. Pat. No. 5,794,388 to Jackman discloses materials used to control water seepage at structural interfaces, such as at a footing and a vertical wall, that employs a pliable panel with a water flow path between the panel footing and the floor surface.

In contrast to these references and the known prior art, the present invention uses a continuing sheet of waterproof or damp proof material that has built in pleats which engage the surface areas at or adjacent to corners or angles of an existing structural interfacing surfaces over which sheet is to be applied all as will be described in detail hereafter.

SUMMARY OF THE INVENTION

This invention relates to weatherproofing covering material used over an existing sub structural material having angular interfacing surfaces. Located in the covering material at or adjacent to where the existing sub surfaces interface are a series of pleats within the covering material.

It is the primary object of the present invention to provide for an improved weather proofing covering used over existing sub surfaces having angular interfaces.

Another object is to provide for such a covering having pleats therein permitting the material to be folded around the angles of the existing surfaces to provide a weather tight barrier.

These and other objects and advantages ot the present invention will become apparent to readers from a consideration of the ensuing description and the accompanying drawings.

DESCRIPTION OF THE PREFERRED EMBODIMENT

Figure 1:
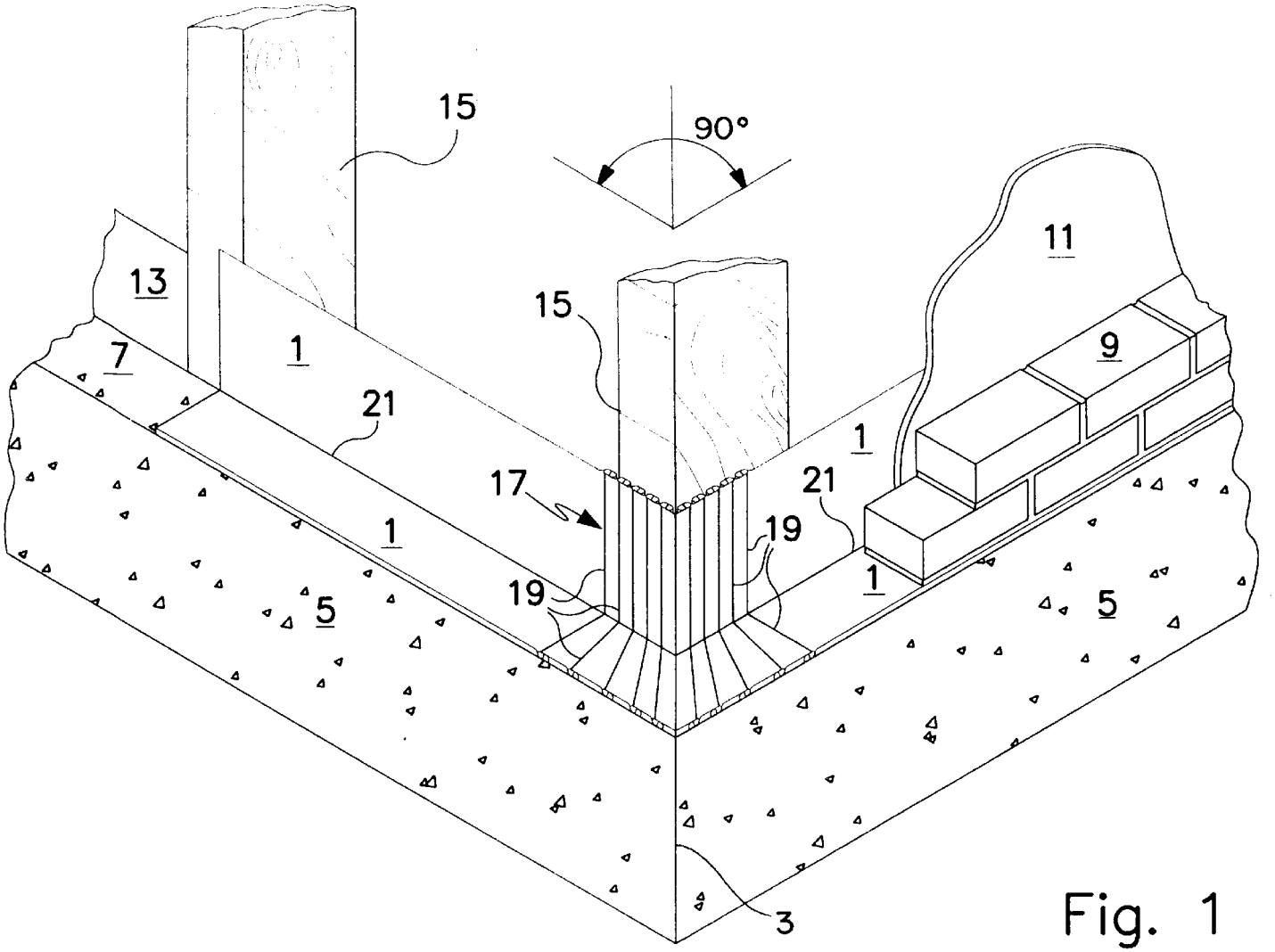
FIG. 1 is a perspective view of the present invention applied over the foundation corner of a building.

FIG. 1 is a perspective view of the present invention 1 applied over the foundation corner of a building. The existing building's outside vertical corner edge 3 designates where the two sub structural building elements interface at a right angle or 90 degrees. The lower existing concrete foundation has a vertical front facing surface 5 and a horizontally disposed upper surface 7. Shown to the right is the partially constructed outside brick veneer surface 9 and the builder's felt 11 material which overlaps the sheeting of the present invention. To the left is the conventional wooden sill plate 13. Extending vertically are the two partially shown wooden framing members 15. Except for the sheeting making up the present invention 1, all of the shown material elements are conventional and are shown arranged in a typical building set up.

The material making up the present invention 1 has one continuous sheet of waterproofing or damp proofing material with an expandable center pleated area 17 disposed over and on both adjacent sides of the existing centerline of the outside building corner 3. The pleated area 17 of the sheeting material has folds with ten shown pleat edges 19, five on each side of the corner 3. Behind these shown pleat edges and parallel to them is another set of a like number of concealed pleat edges. Over the vertical sub surfaces the pleats of sheeting member 1, both the shown 19 and the concealed pleated edges, are generally parallel to the vertical portions of the corner edge 3. Overlying the horizontally disposed foundation 7, the pleated edges 19 can be made to fan out or expand to accommodate and cover a greater surface areas by the pleats than on the vertical sub surfaces.

This expansion from parallel narrow pleats to where they expand takes place at the interface line defined by the edges 21 between the joining vertical and horizontal concrete building sub surfaces 5 and 7 under the flexible material making up the sheeting material 1. With this set up the centerline of the sub surfaces is the corner 3 and the center of the sheeting and pleated area is approximately directly over the centerline.

Figure 2:
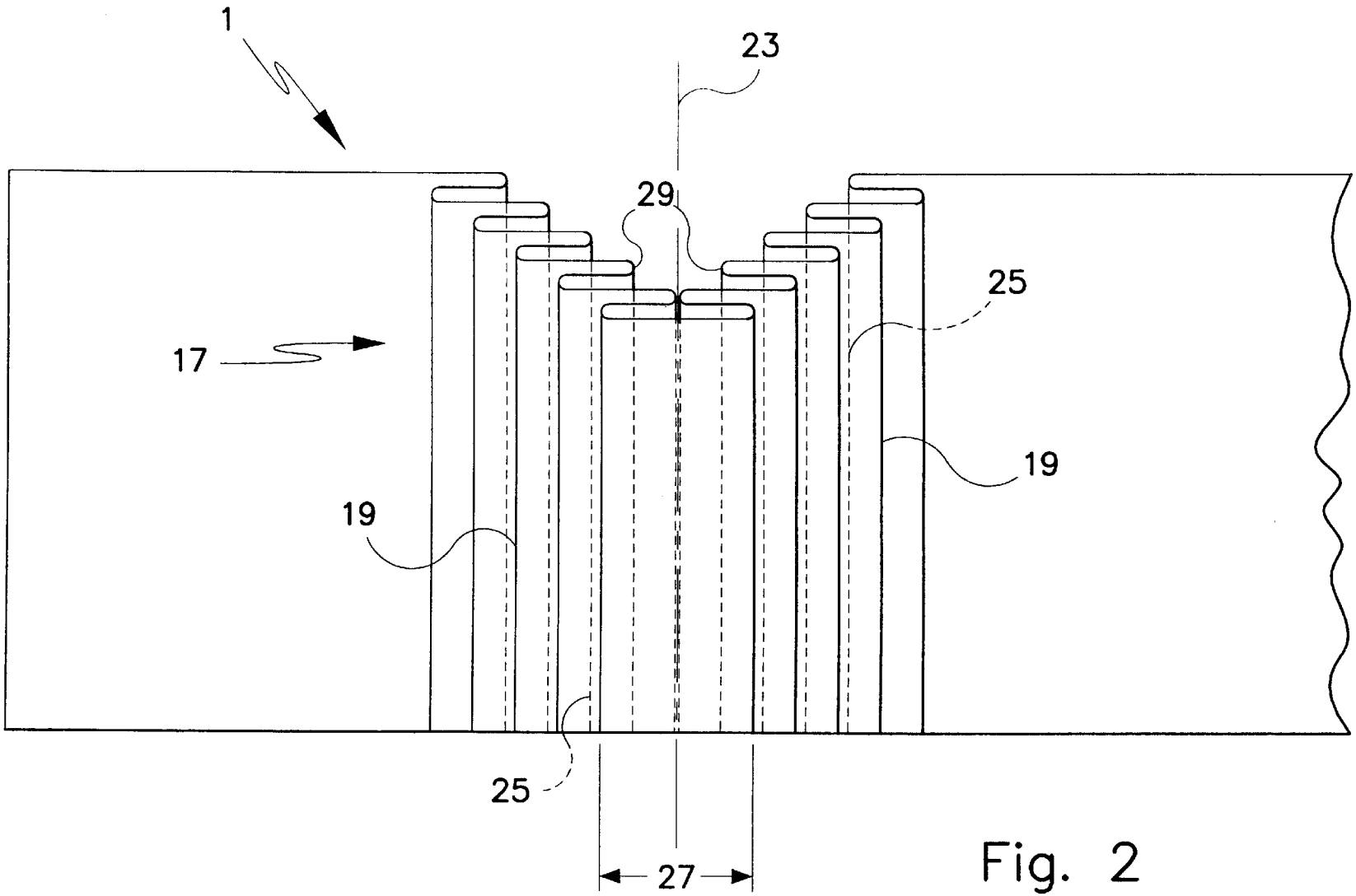
FIG. 2 shows a front view of the covering material used in FIG. 1 before it is sewn but after it is folded.

FIG. 2 shows a front view of the covering material used in FIG. 1 after it is folded into pleats but before a section of its pleated area 17 is sewn together at the folds. The center line 23 of the sheeting 1 vertically goes through two identical pleated sides. The right side of the sheeting material 1, a mirror image of the left side, is partially shown. Each pleated side from the center line 23 has 10 folds per side with 10 pleat edges. Five of the pleated edges 19 on each side are shown as in FIG. 1. Behind and parallel to these five shown pleat edges are the five concealed pleat edges 25 on each side of the center line 23. The horizontal distance 27 each fold is apart is the same and was one inch in one embodiment. Except for the front center fold, half of the fold's horizontal distance 27 is visually covered over by the adjacent fold surface area. The joining sheet curvature 29 when the fold surfaces meet is the same for each fold and had a diameter of ⅝ of an inch in the same mentioned embodiment. The sheeting material making up the sheet 1 along with all of its pleats and folds is a continuous surface material extending to the particular outer limits, shown as rectangular, selected for the sheeting material 1.

Figure 3:
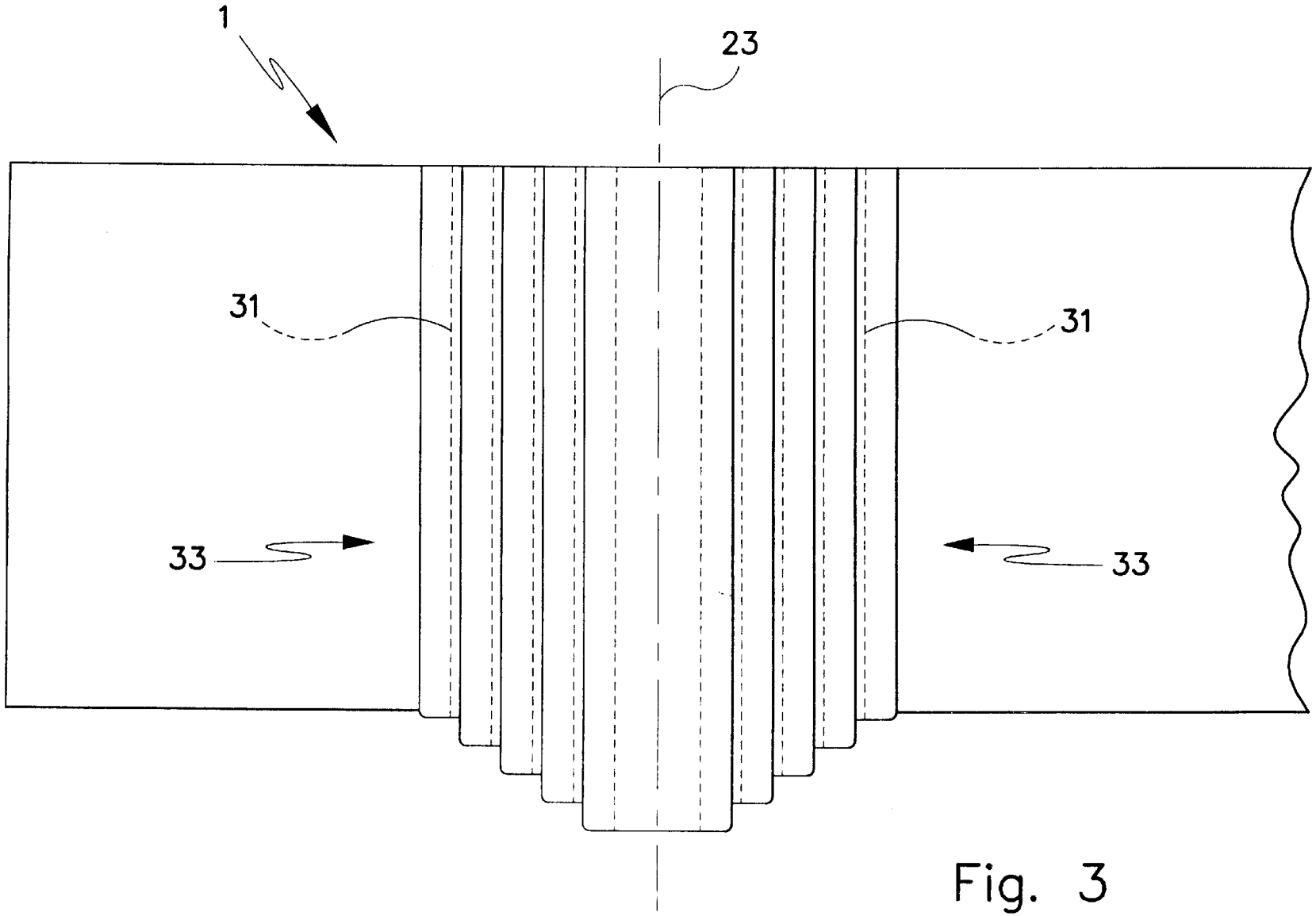
FIG. 3 shows a front view of the covering material used in FIGS. 1–2 after sewing has taken place.

FIG. 3 shows a front view of the covering sheeting material 1 used in FIGS. 1–2 after sewing has taken place on a section of its folds. This view is essentially the same as in FIG. 2 except that the upper section of the folds on each side have been stitched down a predetermined distance from the top. The dotted vertical lines 31 represent this stitching used to bind adjacent folds of the upper section together. In FIG. 1, the upper area of the pleat sheeting that is stitched together or restricted in expansion would correspond to the parallel vertical folds 19 shown. The lower or terminal end of the stitching of folds together would be stop at the interfacing edge 21 in the same figure. Thus, when it is desired to restrict the expansion of the flexible expandable folds, the restrictive stitching is used to hold a section of the folds together. Clearly this stitching process requires some forethought and the measurement of the sub surfaces to determine where it is desired to have the folds restricted and where the same should terminate. Below the stitching 31, in the lower fold surface area designated by the numbers 33, the fold material can be expanded to its normal limits to accommodate and cover a larger sub surface area, such as is shown in the covered horizontal foundation surface 7 area covered in FIG. 1.

Depending on the sub surface areas to be covered by the sheeting material 1 and the angular interface between these interfacing sub surface areas, each pleat arrangement can be sewn or not sewn along the pleat's folds to customize its deployment over the angular area where the sub surfaces meet. Sub surfaces having interfacing angular varying from around 90 up to and including 120 degrees have successfully been covered by the sheeting material 1 without any leakage of moisture past them. Other sub surface angular variations are, of course, possible and expected to be covered.

One type of waterproofing material that has been used successfully for the sheeting material 1 is a reinforced dual polycrepe. Essentially this material it is a polyethylene film bonded to each side of an asphalt treated creped kraft paper that is reinforced by fiberglass scrim. This material comes in large sheets (5 feet by 125 feet and 0.05 mm thick) and is cut to specific ordered sizes. This sheeting material has the requisite waterproofing capabilities and is flexible enough to bend around corners or angles as desired. Other similar materials with the requisite characteristics could also be used.

While waterproofing the corners of foundations of building has proven to be one very successful use of this invention, clearly it can be used in any construction project, commercial or residential, where it is desired to waterproof interfacing sub surfaces joined at an angle.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sub surface covering system comprising:

building material sub surface areas having two interfacing surface areas that meet angularly at a centerline; and a waterproof protective covering extending from over the centerline and the adjacent interfacing surface areas;

said waterproof covering having an expandable pleated area with a plurality of folds, said pleated area extending over and covering the centerline and a portion of the adjacent interfacing surface areas covered by said waterproof protective covering whereby the covered surfaces areas of said two interfacing surfaces is protected from exterior moisture.

2. The system as claimed in claim 1, wherein said plurality of folds are the same on each side of the centerline.

3. The system as claimed in claim 1, also including means to restrict the normal expansion of a section of said folds while allowing the remainder of the folds to expand normally.

4. The system as claimed in claim 3, wherein there are at least three folds on each side of the centerline.

5. The system as claimed in claim 4, wherein the folds are in the center of said pleated area, said center of the pleated area coinciding substantially with the centerline of the sub surface areas.

6. The system as claimed in claim 5, wherein the sub surface areas are foundational concrete elements of a building, each of said surfaces areas having a horizontally disposed concrete surface and a vertically disposed concrete surface.

* * * * *